US012715722B2

(12) United States Patent
Kawaguchi et al.

(10) Patent No.: US 12,715,722 B2
(45) Date of Patent: Aug. 25, 2026

(54) SHEET FEEDING APPARATUS AND IMAGE FORMING APPARATUS

(71) Applicant: CANON KABUSHIKI KAISHA, Tokyo (JP)

(72) Inventors: Masaki Kawaguchi, Kanagawa (JP); Yohei Katto, Chiba (JP); Takuya Hayakawa, Saitama (JP); Hiroshi Sagawa, Ibaraki (JP); Yutaka Ando, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 18/770,458

(22) Filed: Jul. 11, 2024

(65) Prior Publication Data

US 2025/0019192 A1 Jan. 16, 2025

(30) Foreign Application Priority Data

Jul. 13, 2023 (JP) ..... 2023-115500

(51) Int. Cl.
*B65H 3/48* (2006.01)
*B65H 7/16* (2006.01)

(52) U.S. Cl.
CPC ..... *B65H 3/48* (2013.01); *B65H 7/16* (2013.01); *B65H 2515/10* (2013.01); *B65H 2515/40* (2013.01); *B65H 2515/805* (2013.01); *B65H 2801/06* (2013.01)

(58) Field of Classification Search
CPC ..... B65H 3/48; B65H 7/16; B65H 2515/10; B65H 2515/40; B65H 2515/805; B65H 2801/06
See application file for complete search history.

(56) References Cited

U.S. PATENT DOCUMENTS

2009/0121410 A1* 5/2009 Ueda ..... B65H 3/128 271/11
2020/0140215 A1* 5/2020 Ogasawara ..... B65H 7/16

FOREIGN PATENT DOCUMENTS

JP H0423747 A 1/1992

* cited by examiner

*Primary Examiner* — Thomas A Morrison
(74) *Attorney, Agent, or Firm* — Canon U.S.A., Inc. IP Division

(57) ABSTRACT

A sheet feeding apparatus includes a sheet support portion supporting a sheet or sheets, a sheet feeding unit for performing a sheet feeding operation, an air sheet-separation unit for performing an air blowing operation, and a control unit for performing sheet feeding control to perform the sheet feeding operation by using the sheet feeding unit, in a state where the air blowing operation is in a stopped state, after the air blowing operation is performed by the air sheet-separation unit and the air blowing operation is stopped. In the sheet feeding control, after performing the air blowing operation, the control unit performs the air blowing operation again when performing the sheet feeding operation by using the sheet feeding unit on sheets of a set number of sheets set in advance based on an attribute of the sheet supported on the sheet support portion.

12 Claims, 12 Drawing Sheets

FIG.8

| Single-Side Coated Paper | | | | | |
|---|---|---|---|---|---|
| Number of Sheets to be Separated N [sheets] | | | | | |
| Control Name | Grammage [g/m²] | HH | NN | NL | |
| Single-side coated 1 | – 163 | 10 | 10 | 10 | |
| Single-side coated 2 | 164 – 220 | 9 | 9 | 9 | |
| Single-side coated 3 | 221 – 256 | 8 | 8 | 8 | |

| Double-Side Coated Paper | | | | |
|---|---|---|---|---|
| Number of Sheets to be Separated N [sheets] | | | | |
| Control Name | Grammage [g/m²] | HH | NN | NL |
| Double-side coated 1 | – 163 | 12 | 12 | 12 |
| Double-side coated 2 | 164 – 220 | 11 | 11 | 11 |
| Double-side coated 3 | 221 – 256 | 8 | 10 | 10 |

| Water-Resistant Paper | | | | |
|---|---|---|---|---|
| Number of Sheets to be Separated N [sheets] | | | | |
| Control Name | Grammage [g/m²] | HH | NN | NL |
| Water-resistant paper | 151 – 180 | 9 | 9 | 9 |

SHEET FEEDING APPARATUS AND IMAGE FORMING APPARATUS

BACKGROUND

Field

The present disclosure relates to a sheet feeding apparatus for feeding a sheet, and an image forming apparatus for forming an image on the sheet fed by the sheet feeding apparatus.

Description of the Related Art

In recent years, demands for forming an image on various kinds of sheets have increased, and a sheet with a smooth surface property, such as coated paper, is sometimes used as a recording medium. In a case where a bundle of sheets each with such a smooth surface property is set on a sheet feeding apparatus for feeding the sheets, it is sometimes difficult to feed the sheets because an adhesive force between each set of sheets are high. Japanese Patent Application Laid-open No. 4-23747 discusses a sheet feeding apparatus that separates sheets by blowing air to a sheet bundle to float the sheets.

A generally used control method will be described of feeding a sheet while separating a sheet bundle by blowing air to the sheet bundle, as discussed in Japanese Patent Application Laid-open No. 4-23747, with reference to FIG. 11. As illustrated in FIG. 11, in step S101, the sheet feeding apparatus starts sheet feeding control in response to, for example, a print job start instruction. In step S102, an air blowing operation starts with respect to a sheet bundle. In step S103, the sheet feeding apparatus determines whether a predetermined time has elapsed. While the predetermined time has not elapsed from the start of the air blowing operation (NO in step S103), the processing returns to step S102, and the sheet feeding apparatus continues the air blowing operation. If the predetermined time has elapsed from the start of the air blowing operation (YES in step S103), the processing proceeds to step S104. In step S104, the sheet feeding apparatus performs a sheet feeding operation to feed a sheet to an image forming unit by using a pick-up roller or the like. In step S105, the sheet feeding apparatus determines whether the number of sheets fed to the image forming unit has reached the number of sheets required based on a print job instruction. While the number of fed sheets has not reached the required number of sheets (NO in step S105), the processing returns to step S104, and the sheet feeding apparatus repeats the sheet feeding operation. If the number of fed sheets has reached the required number of sheets (YES in step S105), the processing proceeds to step S106. In step S106, the sheet feeding apparatus stops the air blowing operation, and advances the processing to step S107. In step S107, the sheet feeding apparatus ends the processing.

However, in the above-described sheet feeding control, the predetermined time for blowing air is constant regardless of attributes of the sheet to be fed (e.g., type, size, and grammage). Depending on the sheet attributes or environmental conditions such as an outside temperature and humidity in which the sheet feeding apparatus is installed, there is therefore a possibility of occurring a sheet conveyance problem, such as double feeding in which a plurality of sheets is fed together, without being appropriately separated by blowing the air.

SUMMARY

The present disclosure is directed to a sheet feeding apparatus that can reduce sheet conveyance problems.

According to some embodiments, a sheet feeding apparatus includes a sheet support portion configured to support a sheet or sheets, a sheet feeding unit configured to perform a sheet feeding operation to feed the sheet supported on the sheet support portion, an air sheet-separation unit configured to perform an air blowing operation to separate the sheets by blowing air to a side end of the sheets supported on the sheet support portion, and a control unit configured to perform sheet feeding control to perform the sheet feeding operation by using the sheet feeding unit, in a state where the air blowing operation is in a stopped state, after the air blowing operation is performed by the air sheet-separation unit and the air blowing operation is stopped. In the sheet feeding control, after performing the air blowing operation, the control unit performs the air blowing operation again when performing the sheet feeding operation by using the sheet feeding unit on sheets of a set number of sheets set in advance based on an attribute of the sheet supported on the sheet support portion.

Further features of the present disclosure will become apparent from the following description of exemplary embodiments with reference to the attached drawings.

BRIEF DESCRIPTION OF THE DRAWINGS

FIG. 8 illustrates correspondence tables indicating a number of sheets to be separated.

DESCRIPTION OF THE EMBODIMENTS

Hereinbelow, various exemplary embodiments, features, and aspects of the present disclosure will be described in detail with reference to the attached drawings. First, an image forming system 600 including a sheet feeding deck 500 and an image forming apparatus 201 connected thereto will be described with reference to FIG. 1, which is a diagram illustrating a schematic configuration of the image forming system 600 according to an exemplary embodiment.

[Schematic Configuration of Image Forming System]

Figure 1:
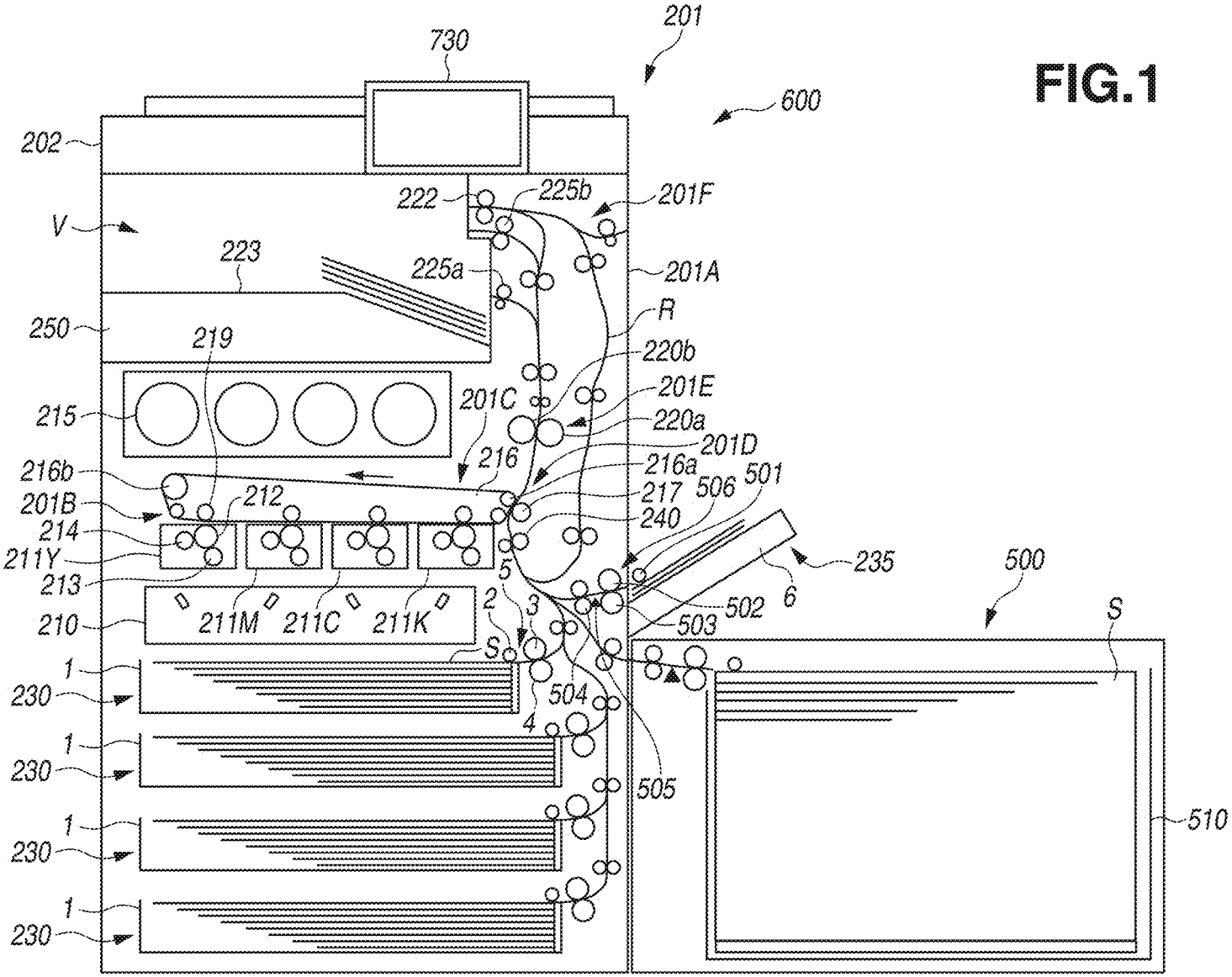
FIG. 1 is a schematic diagram entirely illustrating an image forming system according to an exemplary embodiment.

As illustrated in FIG. 1, the image forming system 600 includes the image forming apparatus 201 and the sheet feeding deck 500 connected to the image forming apparatus 201. The sheet feeding deck 500 is connected to the image forming apparatus 201 on the right side in FIG. 1 so that the image forming apparatus 201 can feed a sheet S.

[Schematic Configuration of Image Forming Apparatus]

As illustrated in FIG. 1, the image forming apparatus 201 includes an image forming apparatus body 201A including an image forming unit 201B for forming an image on a sheet, and an image reading device 202 disposed above the image forming apparatus body 201A. Between the image reading device 202 and the image forming apparatus body 201A, a sheet discharge space V is formed to discharge sheets. Above the image forming apparatus body 201A, an operation unit 730 composed of a touch panel or the like capable of displaying a screen is disposed.

The image forming unit 201B employs a four drum full color system. The image forming unit 201B includes a laser scanner 210, and four process cartridges 211Y, 211M, 211C, and 211K for forming four color toner images (i.e., of yellow (Y), magenta (M), cyan (C), and black (K)). Here, each of the process cartridges 211Y, 211M, 211C, and 211K (herein below, collectively referred to as process cartridges 211) includes a photosensitive drum 212, a charging unit 213, and a development unit 214. Further, the image forming unit 201B includes an intermediate transfer unit 201C and a fixing unit 201E disposed above the process cartridges 211. Above the image forming unit 201B, toner cartridges 215 are arranged to supply toners to the respective development units 214.

The intermediate transfer unit 201C includes an intermediate transfer belt 216 stretched around a drive roller 216*a* and a tension roller 216*b*. Inside the intermediate transfer belt 216, primary transfer rollers 219 are arranged to contact the intermediate transfer belt 216 at positions respectively opposing the photosensitive drums 212. The intermediate transfer belt 216 is rotated by the drive roller 216*a* driven by a driving unit in an arrow direction illustrated in FIG. 1.

The primary transfer rollers 219 sequentially transfer negatively charged toner images of four colors respectively formed on the photosensitive drums 212 onto the intermediate transfer belt 216 in an overlapped manner. A secondary transfer roller 217 for transferring a color image formed on the intermediate transfer belt 216 onto the sheet P is arranged at a position where the secondary transfer roller 217 faces the drive roller 216*a* of the intermediate transfer unit 201C. The intermediate transfer belt 216 and the secondary transfer roller 217 form a secondary transfer portion 201D. Further, the fixing unit 201E including a pressure roller 220*a* and a heating roller 220*b* is disposed above the secondary transfer roller 217. Above the fixing unit 201E, a first discharge roller pair 225*a*, a second discharge roller pair 225*b*, and a sheet reversing unit 201F are disposed. The sheet reversing unit 201F includes a reversing roller pair 222 that can rotate forward and backward, and a re-conveyance path R through which a sheet of which an image is formed on a first surface is conveyed again to the image forming unit 201B, and the like.

A plurality of (four in the present exemplary embodiment) sheet feeding units 230 for feeding out the sheets S set therein to the image forming unit 201B is provided at a lower portion of the image forming apparatus body 201A. Each of the sheet feeding units 230 includes a feeding cassette 1 for storing sheets S and a sheet feeding unit 5 for feeding the sheets S stored in the feeding cassette 1. Each of the sheet feeding units 5 includes a pickup roller 2, and a feed roller 3 and a retard roller 4 serving as a separation unit for separating the sheets S doubly fed by the pickup roller 2.

Further, a manual sheet feeding unit 235 for feeding out the set sheets S to the image forming unit 201B is disposed on the surface of the right side in FIG. 1 of the image forming apparatus body 201A. The manual sheet feeding unit 235 includes a manual sheet feeding tray 6 serving as a sheet support portion for supporting the sheets S. The manual sheet feeding tray 6 is supported to be openable and closable by the image forming apparatus body 201A serving as a housing. A detailed configuration of the manual sheet feeding unit 235 will be described below. The sheet feeding deck 500 for feeding out the set sheets S to the image forming unit 201B is also provided on the surface of the right side in FIG. 1 of the image forming apparatus body 201A and below the manual sheet feeding unit 235.

An image forming operation of the image forming apparatus 201 will now be described. First, when image information of a document is read by the image reading device 202, the image information is then image-processed, converted into an electrical signal, and transmitted to the laser scanner 210 of the image forming unit 201B. The image forming unit 201B sequentially exposes with a laser beam the surface of each of the photosensitive drums 212 uniformly charged by the charging unit 213 to a predetermined polarity and potential. In this way, yellow, magenta, cyan, and black electrostatic latent images are sequentially formed on the photosensitive drums 212 of the process cartridges 211.

Thereafter, the electrostatic latent images are developed with toners of respective colors to be visualized, and the color toner images on the photosensitive drums 212 are sequentially transferred onto the intermediate transfer belt 216 in an overlapped manner, by applying a primary transfer bias applied to each of the primary transfer rollers 219. In this way, a color toner image is formed on the intermediate transfer belt 216.

In contrast, the sheet S conveyed from the feed roller 3 of the sheet feeding unit 230 is conveyed to a registration roller pair 240 configured of a drive roller and a driven roller. At this time, the rotation of the registration roller pair 240 is stopped, and the leading end of the sheet S is brought into contact with the registration roller pair 240. In this way, the leading end of the sheet S is aligned with the registration roller pair 240. Thereafter, a warp (loop) is formed on the sheet S when the sheet S continues to be conveyed by the feed roller 3. When the loop amount reaches a predetermined amount, the registration roller pair 240 starts being driven. In this way, the skew of the sheet S is corrected by the registration roller pair 240, and the skew-corrected sheet S is conveyed by the registration roller pair 240 to the secondary transfer portion 201D. Subsequently, at the secondary transfer portion 201D, the toner image is collectively transferred onto the sheet S by applying a secondary transfer bias to the secondary transfer roller 217. The sheet S with the toner image transferred thereon is conveyed to the fixing unit 201E and is heated and pressurized in the fixing unit 201E. The toners of different colors are melted and mixed to be fixed onto the sheet S as a color image.

The sheet S with the image fixed thereon is discharged to the sheet discharge space V by the first discharge roller pair 225*a* or the second discharge roller pair 225*b* disposed downstream of the fixing unit 201E, and stacked on a stacking portion 223 formed on the bottom surface of the sheet discharge space V. In addition, in a case where images are formed on both sides of the sheet S and after an image is fixed onto a first surface of the sheet S, the sheet S is conveyed to the re-conveyance path R by the reversing roller pair 222 and conveyed to the image forming unit 201B again. An image is then formed on a second surface, which is the opposite surface to the first surface of the sheet S, and the sheet S is discharged to the stacking portion 223.

[Configuration of Manual Sheet Feeding Unit]

Figure 3:
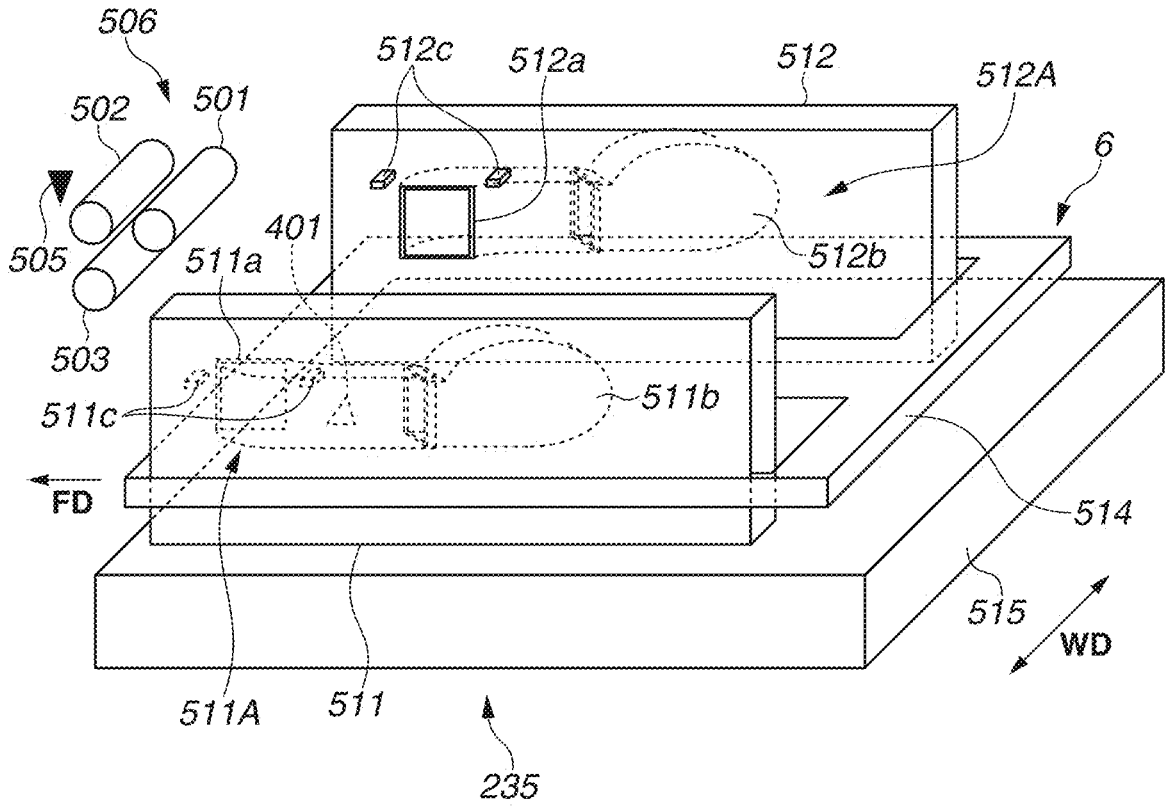
FIG. 3 is a schematic diagram illustrating a configuration of a manual sheet feeding unit.

Next, details of the manual sheet feeding unit 235 serving as a sheet feeding apparatus will be described with reference to FIGS. 1 and 3. FIG. 3 is a schematic diagram illustrating a configuration of the manual sheet feeding unit 235 according to the present exemplary embodiment. As illustrated in FIGS. 1 and 3, the manual sheet feeding unit 235 includes the manual sheet feeding tray 6 and a sheet feeding unit 506 that conveys the sheet(s) S and separate the double fed sheets.

The sheet feeding unit 506 includes a pickup roller 501 serving as a feed roller that contacts the uppermost sheet S of the sheet bundle supported on a sheet stacking plate 514 described below, and conveys the uppermost sheet S. The sheet feeding unit 506 further includes a feed roller 502 and a retard roller 503 serving as a separation unit to separate the sheets S fed from the pickup roller 501.

In the manual sheet feeding unit 235, a drawing roller 504 (refer to FIG. 1) that draws out the sheet S from the feed roller 502 to feed the sheet S to the image forming apparatus 201 is also disposed downstream of the feed roller 502 in the sheet feeding direction. A sheet feeding sensor 505 is disposed in the sheet feeding direction between the feed roller 502 and the drawing roller 504, which is downstream of the sheet feeding unit 506 in the sheet feeding direction. The sheet feeding sensor 505 detects the passage of the sheet S by outputting a signal depending on whether the sheet S is present.

As illustrated in FIG. 3, the manual sheet feeding tray 6 is also provided with the sheet stacking plate 514 for stacking and supporting a sheet bundle including a plurality of the sheets S, a supporting base 515 for supporting the sheet stacking plate 514, and a sheet presence/absence sensor 401. The sheet presence/absence sensor 401 can detect the presence/absence of the sheet S (including the sheet bundle) on the sheet stacking plate 514. For example, the sheet presence/absence sensor 401 may be a flag sensor that detects a flag position moved by being pressed by the sheets S stacked on the sheet stacking plate 514, or may be an optical sensor that detects light reflected from the sheet S.

The manual sheet feeding tray 6 also includes side end regulation plates 511 and 512, and a rear end regulation plate 513. The side end regulation plates 511 and 512 serving as regulation members regulate the end portions (side ends of the sheet) in a width direction WD of the sheet S set on the sheet stacking plate 514. The width direction WD of the sheet S is a direction orthogonal to a sheet feeding direction FD of the sheet S or the sheet bundle. The rear end regulation plate 513 regulates an upstream side end of the sheet S (rear end of the sheet S) in the sheet feeding direction.

The side end regulation plates 511 and 512 are respectively provided with the air blowing units 511A and 512A serving as air sheet-separation units. The air blowing unit 511A of the side end regulation plate 511 includes a fan 511*b* driven by a fan motor 511M (refer to FIG. 2), and a blowing nozzle 511*a* for guiding the air blown from the fan 511*b* and blowing the guided air to a side end of the sheet bundle. Similarly, the air blowing unit 512A of the side end regulation plate 512 includes a fan 512*b* driven by a fan motor 512M (refer to FIG. 2), and a blowing nozzle 512*a* for guiding the air blown from the fan 512*b* and blowing the guided air to the other side end of the sheet bundle. The blowing nozzles 511*a* and 512*a* serving as air blowing ports each have a function of a duct for guiding the air in the side end regulation plates 511 and 512. The side end regulation plates 511 and 512 are provided with floating prevention plates 511*c* and 512*c* near the blowing nozzles 511*a* and 512*a* to prevent the air-blown sheet S from floating and overriding the side end regulation plates 511 and 512, respectively.

[Configuration of Control System of Image Forming System]

Figure 2:
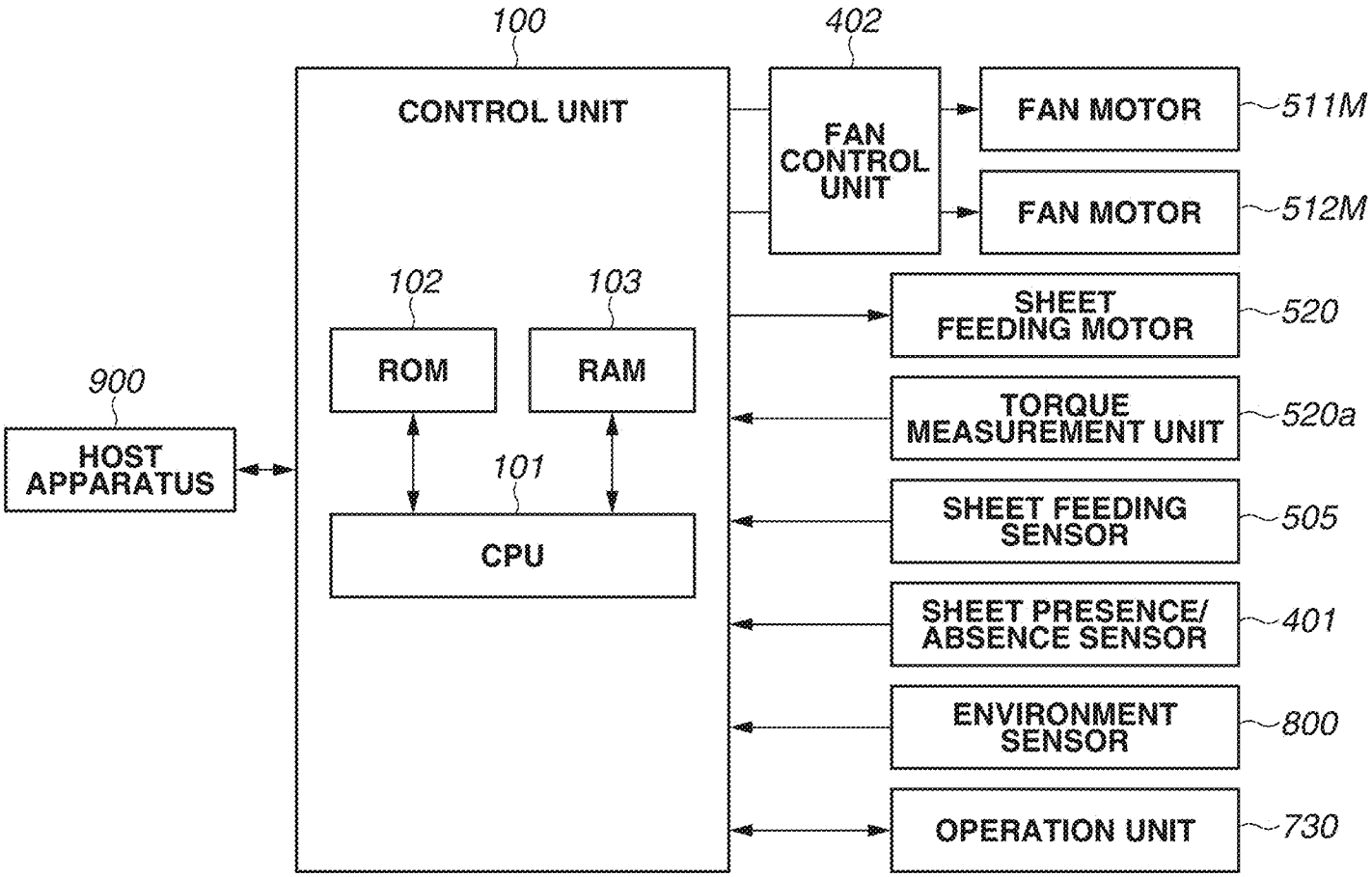
FIG. 2 is a block diagram illustrating a control system of the image forming system.

Next, a configuration of a control system of the image forming system 600 will be described with reference to FIG. 2, which is a block diagram illustrating the control system of the image forming system 600 according to the present exemplary embodiment.

A control unit 100 according to the present exemplary embodiment is included in, for example, the image forming apparatus 201. The control unit 100 includes a central processing unit (CPU) 101, a read only memory (ROM) 102, and a random access memory (RAM) 103. The ROM 102 stores various kinds of programs. The CPU 101 may include one or more processors, circuitry, or combinations thereof and can read a program from the ROM 102 to execute the read program. The RAM 103 works as a work area for the CPU 101. The control unit 100 integrally controls the image forming apparatus 201 and the sheet feeding deck 500. The control unit 100 is connected to a host apparatus 900 and the operation unit 730 to exchange information and performs signal processing for various kinds of processing apparatuses, sequence controls, and the like. In addition, the host apparatus 900 is an external apparatus, such as a personal computer, an image scanner, and a facsimile machine. The operation unit 730 operable by a user will be described below.

The control unit 100 is connected to a fan control unit 402, and a sheet feeding motor 520 serving as a motor for driving the pickup roller 501. The control unit 100 is also connected to a torque measurement unit 520*a* for measuring a motor torque of the sheet feeding motor 520, the above-described sheet feeding sensor 505, the sheet presence/absence sensor 401, and an environment sensor 800. The fan control unit 402 is connected to the fan motors 511M and 512M to control the fan motors 511M and 512M to rotate the fans 511*b* and 512*b*, and at the same time, detect troubles of the fans 511*b* and 512*b*. It is possible to determine whether the fans 511*b* and 512*b* are in trouble by, for example, counting the number of rotations of each of the fans 511*b* and 512*b*, and determining whether the counted number of rotations reaches an intended number of rotations.

In addition, the torque measurement unit 520*a* is a unit to measure the motor torque of the sheet feeding motor 520, but may be, for example, a current sensor for detecting a value of the current flowing through the sheet feeding motor 520, or a torque sensor for detecting a torque generated in the pickup roller 501. In other words, the torque measurement unit 520*a* may have any configuration as long as the torque measurement unit 520*a* can directly or indirectly measure the motor torque of the sheet feeding motor 520. The environment sensor 800 detects the temperature and humidity around the manual sheet feeding tray 6.

[Operation at Air Blowing Time]

Figure 4:
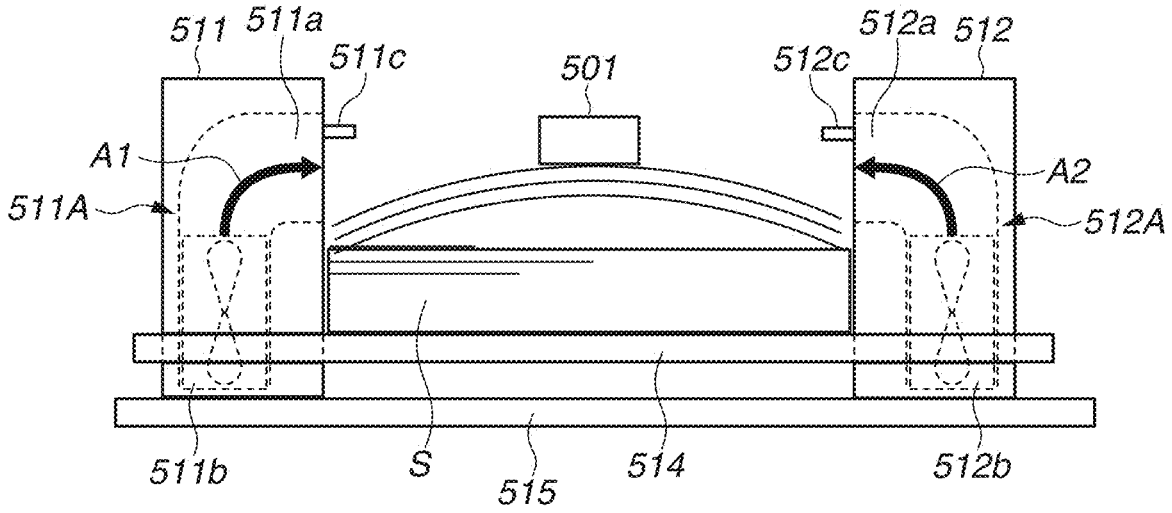
FIG. 4 is a schematic diagram illustrating a state where the manual sheet feeding unit performs an air blowing operation.
Figure 10:
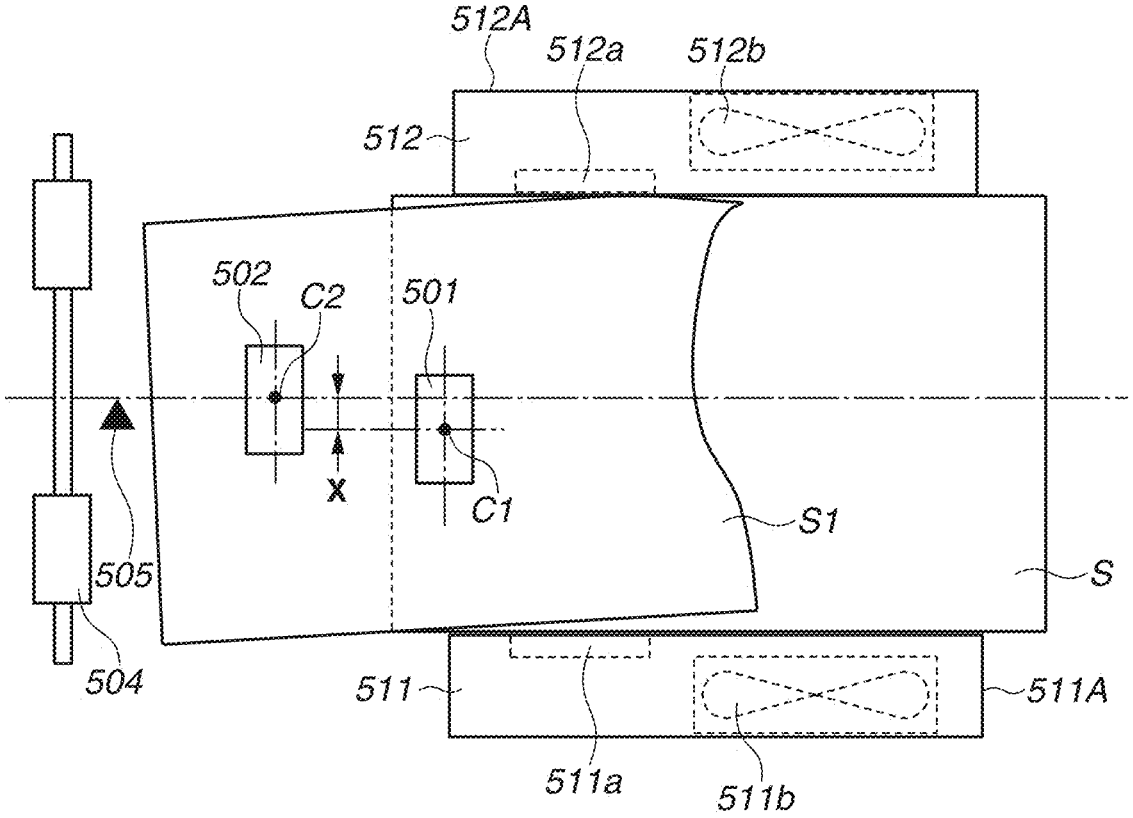
FIG. 10 is a diagram illustrating a turning force generated from a relationship between a pickup roller and a feed roller.
Figure 11:
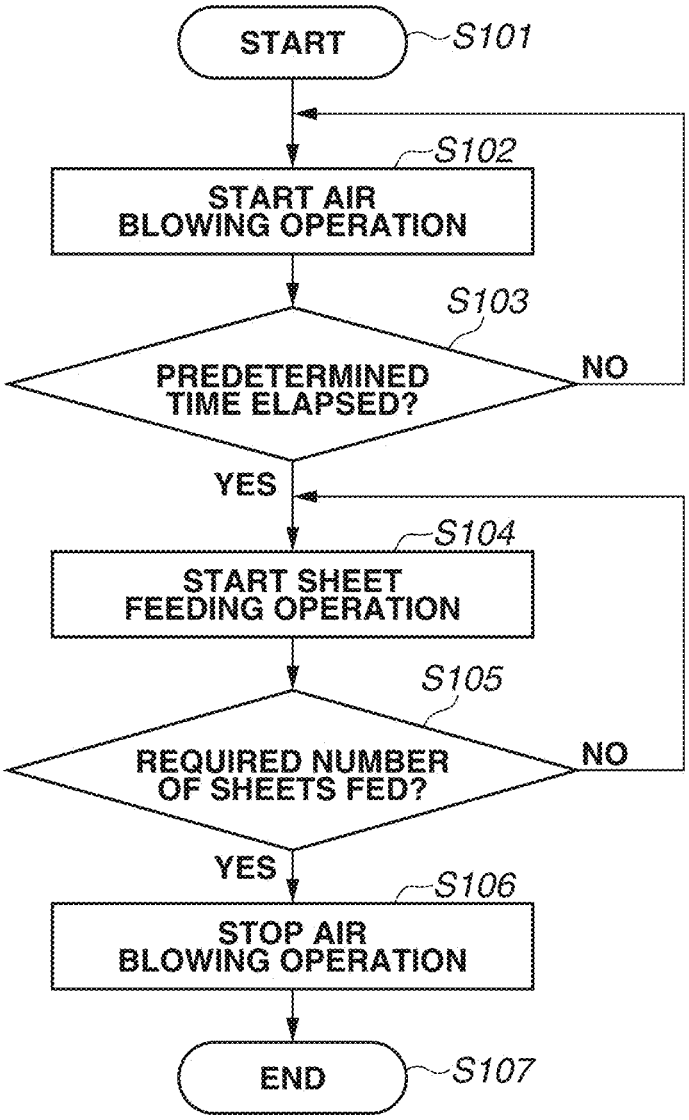
FIG. 11 is a flowchart illustrating a procedure of general sheet feeding control.

Next, a state of the sheet S in a case where air is blown toward the sides of the sheet bundle by the air blowing units 511A and 512A, and a state where the sheet S is fed while being blown by the air, will be described with reference to FIGS. 4 and 10. FIG. 4 is a schematic diagram illustrating a state where an air blowing operation is performed in the sheet feeding deck 500 according to the present exemplary embodiment. FIG. 10 is a diagram illustrating a turning force generated by a positional relationship between the pickup roller 501 and the feed roller 502.

As illustrated in FIG. 4, in the air blowing operation, the fans 511*b* and 512*b* of the air blowing units 511A and 512A blow air toward the sides of the sheet bundle in arrow A1 and A2 directions, respectively. The uppermost several to several tens of sheets S of the sheet bundle are then separated and floated, but the floating prevention plates 511*c* and 512*c* prevent the sheets S from floating up. In this way, the adhesive force between each set of the floating sheets S is reduced, and the sheets S can be fed by the pickup roller 501, even if the sheets S have a smooth surface property, such as coated paper.

Meanwhile, there may be a case where the positions of a center C1 of the pickup roller 501 and a center C2 of the feed roller 502 are misaligned, for example, by a distance X in a width direction orthogonal to the sheet feeding direction as illustrated in FIG. 10, due to a design in relation to other components. In such a case, if a conveyance load is generated due to, for example, the conveyance speed difference near the pickup roller 501 while the uppermost sheet S1 is being conveyed by the feed roller 502, a turning force is generated on the sheet S1 in a counterclockwise direction.

Thus, the sheet S1 is conveyed while rotating to cause a skew feeding of the sheet S1. In this case, even if the turning force is generated on the sheet S1, the side ends of the sheet S1 are normally brought into contact with the side end regulation plates 511 and 512 to prevent the skew feeding due to the stiffness of the sheet S1.

However, since the sheet S1 is floating due to the air blowing from the air blowing units 511A and 512A, the sheet S1 is easy to warp as illustrated in FIG. 10. Thus, the effect of preventing the skew feeding of the sheet S1 by the side end regulation plates 511 and 512 may be reduced to increase the skew feeding amount of the sheet S1. Thus, in the present exemplary embodiment, sheet attribute setting control, sheet feeding control, and setting control of a predetermined number of sheets are performed as described below.

[Sheet Attribute Setting Control]

Figure 5A:
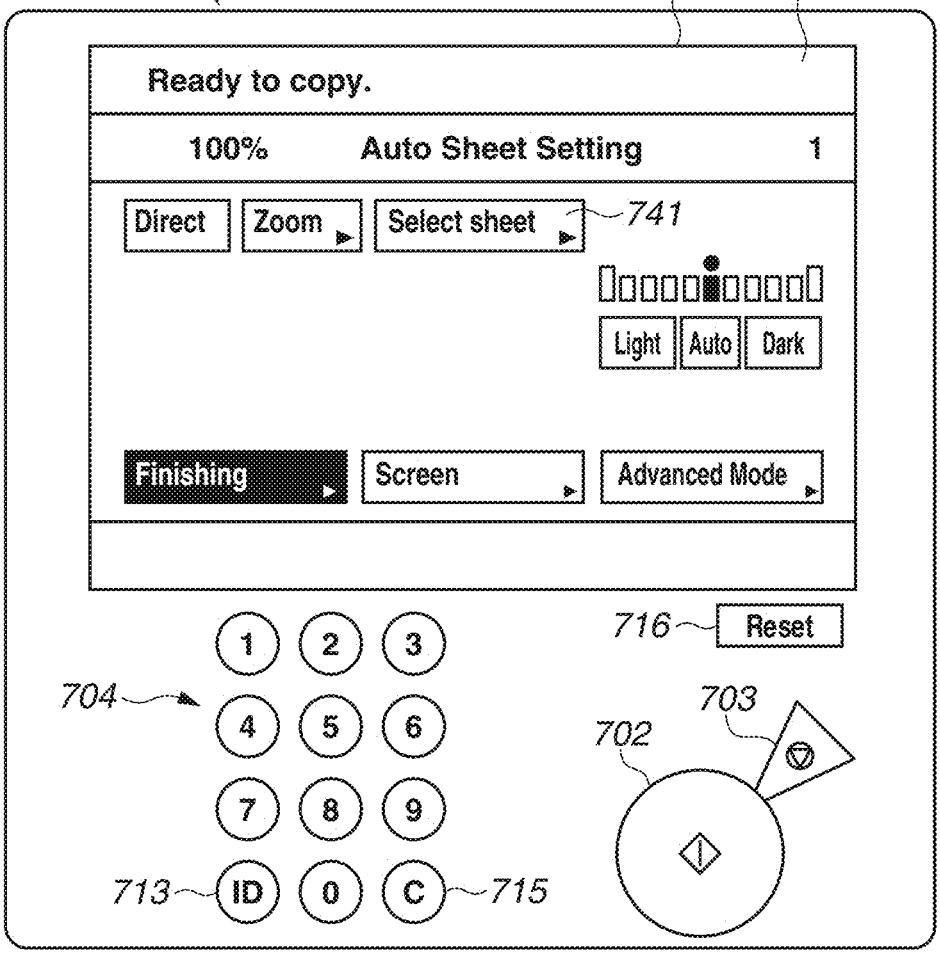
FIG. 5A is a front view of an operation unit.
Figure 5B:
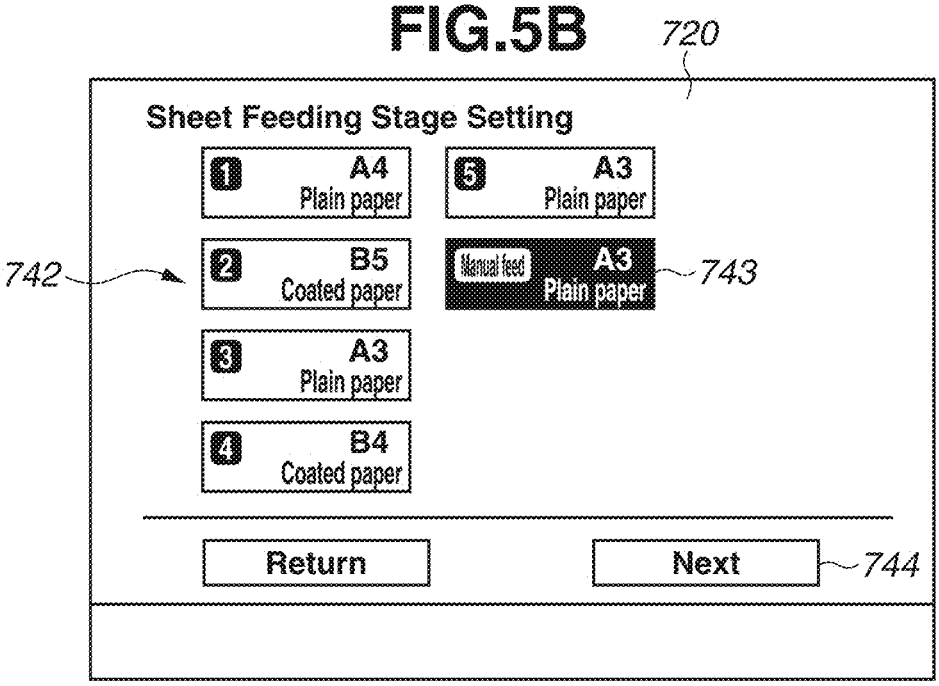
FIGS. 5B, 5C, and 5D are front views each illustrating a screen of a display unit.
Figure 5C:
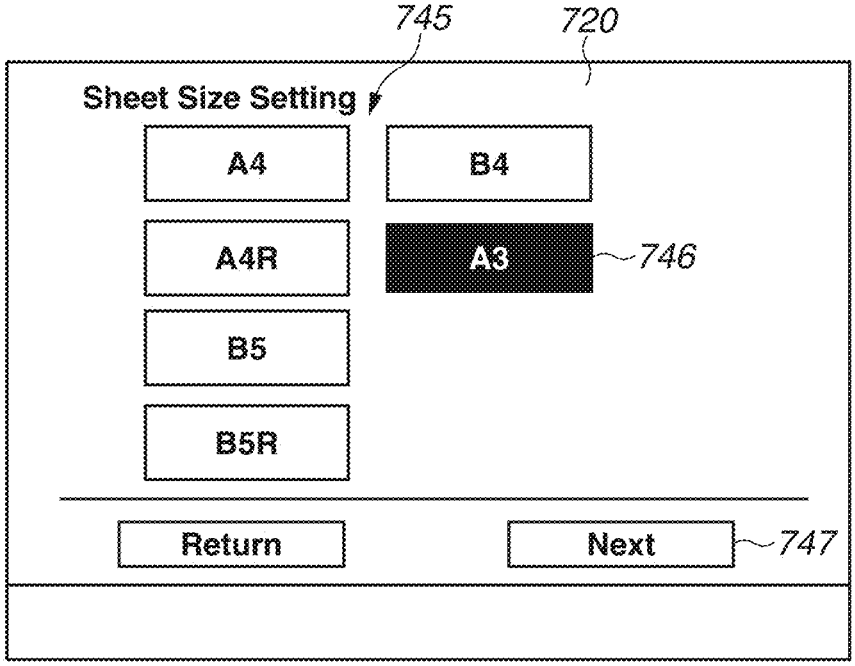
Figure 5D:
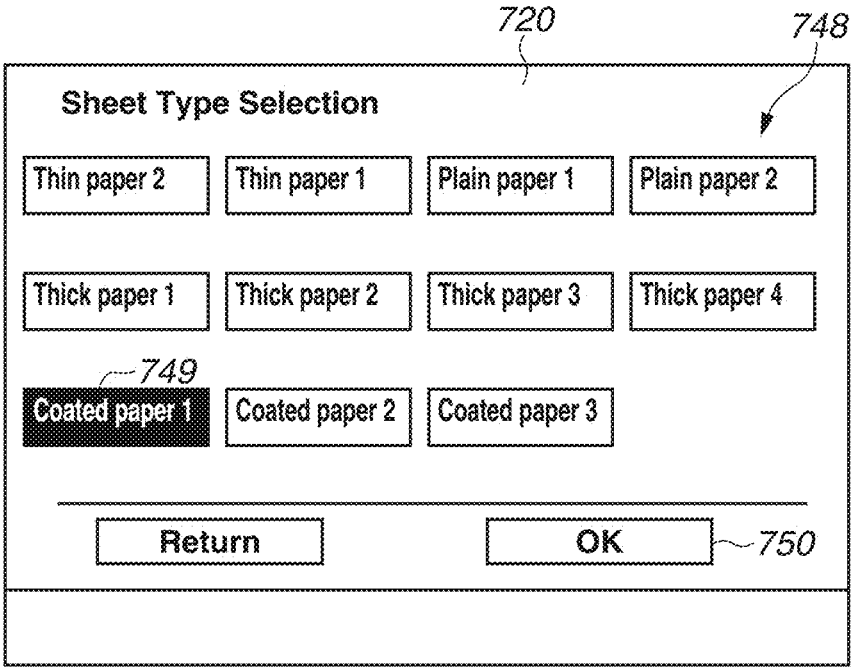
Figure 6:
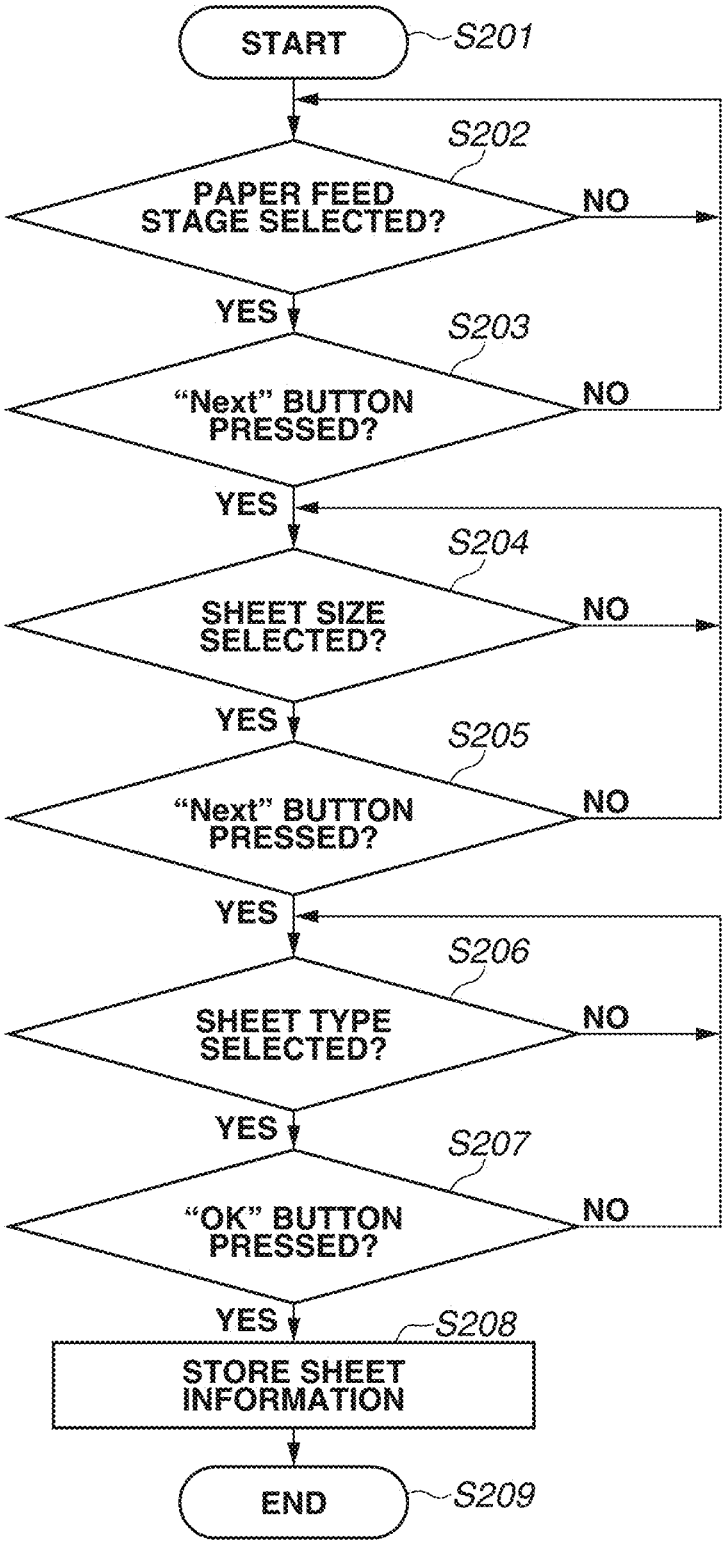
FIG. 6 is a flowchart illustrating a procedure of sheet attribute setting control.

The sheet attribute setting control will now be described with reference to FIGS. 5A to 6. FIG. 5A is a front view of the operation unit 730, and FIGS. 5B to 5D are front views each illustrating a screen on a display portion 720 of the operation unit 730. FIG. 6 is a flowchart illustrating a procedure of the sheet attribute setting control.

As illustrated in FIG. 5A, the operation unit 730 includes the display portion 720, a start key 702, a stop key 703, numeric keys 704, an identification ("ID") key 713, a clear ("C") key 715, and a "Reset" key 716. The start key 702 is a key to issue an instruction to start an image forming operation. The stop key 703 is a key to issue an instruction to interrupt the image forming operation. The numeric keys 704 are keys used to enter numerals. The "C" key 715 is a key to clear the numerals input via the numeric keys 704. The "Reset" key 716 is a key used to return the settings to default values.

The display portion 720 is composed of a touch panel and can display screens illustrated in FIGS. 5A to 5D. The display portion 720 can also generate software keys on the screen. As illustrated in FIG. 5A, the display portion 720 can display a standby screen 720*a*. When the "Reset" key 716 is pressed in a state where a screen other than the standby screen 720*a* is displayed on the display portion 720, the screen returns to the standby screen 720*a*. On the standby screen 720*a*, a "Select sheet" button 741 is displayed, and when a user presses the "Select sheet" button 741, the display portion 720 changes to a screen illustrated in FIG. 5B.

On the screen illustrated in FIG. 5B, a paper feed stage setting area 742 and a "Next" button 744 are displayed. In the paper feed stage setting area 742, paper feed stages for the image forming apparatus 201, i.e., locations of sheet feed sources, are displayed. When any one of the sheet feeding stages displayed in the paper feed stage setting area 742 is pressed, the button of the pressed paper feed stage becomes grayed out to indicate that the paper feed stage is selected. In FIG. 5B a "Manual feed" button 743 corresponding to the manual sheet feeding unit 235 is selected as an example. When the user presses the "Next" button 744, the display portion 720 then displays a screen illustrated in FIG. 5C.

On the screen illustrated in FIG. 5C, a sheet size setting area 745 and a "Next" button 747 are displayed. In the sheet size setting area 745, sheet sizes usable for the paper feed stage set in the paper feed stage setting area 742 (e.g., manual sheet feeding unit 235) are displayed. When any one of the sheet sizes displayed in the sheet size setting area 745 is pressed, the pressed sheet size button becomes grayed out to indicate that the sheet size is selected. In FIG. 5C, an "A3" button 746 corresponding to the A3 size is selected as an example. By selecting any one of the sheet sizes displayed in the sheet size setting area 745, the sheet size set in the paper feed stage set in the paper feed stage setting area 742 can be designated. When the user presses the "Next" button 747, the display portion 720 then displays a screen illustrated in FIG. 5D.

On the screen illustrated in FIG. 5D, a sheet type setting area 748 and an "OK" button 750 are displayed. In the sheet type setting area 748, sheet types usable for the paper feed stage set in the paper feed stage setting area 742 (e.g., manual sheet feeding unit 235) are displayed. When any one of the sheet types displayed in the sheet type setting area 748 is pressed, the pressed sheet type button becomes grayed out to indicate that the sheet size is selected. In FIG. 5D, the "Coated paper 1" button 749 corresponding to the coated paper 1 is selected, as an example. By selecting any one of the sheet types displayed in the sheet type setting area 748, the sheet type set in the paper feed stage set in the paper feed stage setting area 742 can be designated.

When the user presses the "OK" button 750, the sheet attribute setting control for setting the sheet attribute then ends. The sheet attributes include a sheet size, a sheet type, and a grammage of the sheet. For example, the "coated paper 1" means "Single-side coated 1" in a table in FIG. 8 indicating single-side coated paper with a grammage of 163 $g/m^2$ (grams per meter squared) or less. On the screen illustrated in FIG. 5D, buttons to select double-side coated paper or water-resistant paper are not displayed, but the double-side coated paper and the water-resistant paper can also be selected. If a "Return" button illustrated in each of FIGS. 5B to 5D is pressed, the display portion 720 displays the previous screen.

The sheet attribute setting control will now be described with reference to a flowchart in FIG. 6. As illustrated in FIG. 6, the control unit 100 starts, in step S201, the sheet attribute setting control in response to the pressing of the "Select sheet" button 741 illustrated in FIG. 5A. In step S202, the control unit 100 determines whether any one of the paper feed stages is selected in the paper feed stage setting area 742 illustrated in FIG. 5B.

In a case where one of the paper feed stages in the paper feed stage setting area 742 is pressed (YES in step S202), the processing proceeds to step S203. In step S203, the control unit 100 determines whether the setting of the paper feed stage is completed. More specifically, the control unit 100 determines, in step S203, whether the "Next" button 744 illustrated in FIG. 5B is pressed. In a case where the setting of the paper feed stage is not completed (NO in step S203), the processing return to step S202.

In a case where the setting of the paper feed stage is completed (YES in step S203), the processing proceeds to step S204. In step S204, the control unit 100 determines whether any one of the sheet sizes in the sheet size setting area 745 illustrated in FIG. 5C is pressed. In a case where one of the sheet sizes in the sheet size setting area 745 is pressed (YES in step S204), the processing proceeds to step S205. In step S205, the control unit 100 determines whether the setting of the sheet size is completed. More specifically, the control unit 100 determines, in step S205, whether the "Next" button 747 illustrated in FIG. 5C is pressed. In a case where the setting of the sheet size is not completed (NO in step S205), the processing returns to step S204.

In a case where the setting of the sheet size is completed (YES in step S205), the processing proceeds to step S206. In step S206, the control unit 100 determines whether any one of the sheet types in the sheet type setting area 748 illustrated in FIG. 5D is pressed. In a case where one of the sheet types in the sheet type setting area 748 is pressed (YES in step S206), the processing proceeds to step S207. In step S207, the control unit 100 determines whether the selection of the sheet type is completed.

More specifically, the control unit 100 determines, in step S207, whether the "OK" button 750 illustrated in FIG. 5D is pressed. In a case where the setting of the sheet type is not completed (NO in step S207), the processing returns to step S206.

In a case where the setting of the sheet type is completed (YES in step S207), the processing proceeds to step S208. In step S208, the control unit 100 stores in the RAM 103 sheet information regarding the sheet attributes selected and set in steps S202, S204, and S206, and the processing proceeds to step S209. In S209, the control unit 100 ends the sheet attribute setting control. In this way, the control unit 100 can set the attributes of the sheet supported on the manual sheet feeding tray 6, based on the operations of the operation unit 730. When the sheet attribute setting control ends, the display portion 720 displays the standby screen 720*a* illustrated in FIG. 5A.

After the sheet information is stored in the RAM 103 and the start key 702 of the operation unit 730 is pressed, a job is started and the sheet S is fed from the paper feed stage selected in the sheet information. The sheet information does not necessarily have to be set every time before a job starts. A user only presses the start key 702 in a case where, for example, a job is to be executed after the sheet information is stored in the RAM 103 and the user desires to execute the job based on the same sheet information again.

[Sheet Feeding Control]

Next, a sheet feeding control of the manual sheet feeding unit 235 according to the present exemplary embodiment will be described with reference to FIG. 7, which is a flowchart illustrating a procedure of the sheet feeding control. In step S301, the control unit 100 starts the sheet feeding control to feed a sheet, in response to the start of the printing by the image forming apparatus 201. In step S302, the control unit 100 determines whether the number of feedable sheets is more than 0, i.e., 1 or more. In a case where the number of feedable sheets is more than 0 (YES in step S302), the processing proceeds to step S307.

In contrast, the number of feedable sheets is 0 (NO in step S302), the processing proceeds to step S303. In step S303, the control unit 100 drives the fan motors 511M and 512M to start an air blowing operation to blow air by using the air blowing units 511A and 512A to the sides of the sheet bundle. With this operation, the floating up of the sheet S is regulated (refer to FIG. 4) by the floating prevention plates 511*c* and 512*c* while the uppermost several or several tens of sheets S are separated and floated, and the adhesive force between the sheets S are reduced.

Since the fan motors 511M and 512M start rotating from a rotation stopped state, a predetermined time period, for example, 10 seconds is set in advance as a time period until the rotation speed of each of the fan motors 511M and 512M reaches the desired number of rotations (i.e., rotation speed), and also until the floating of the sheets S become stable. The air blowing operation continues until the predetermined time period elapses (NO in step S304). In a case where the predetermined time has elapsed (YES in step S304), the processing proceeds to step S305. In step S305, the control unit 100 stops the air blowing operation, i.e., turns off the driving of the fan motors 511M and 512M.

With this operation, the sheets S in the floating state tends to return to the state of the sheet bundle before floating while the air between the sheets S is being flowing out, but it takes a certain time to return to the state of the sheet bundle before the floating. Since the adhesive force between the sheets S is kept being reduced until the state of the sheets S returns to the state of the sheet bundle before the floating, even a sheet bundle with high adhesive forces can be fed while restraining the double feeding. In step S306, since the state capable of feeding the sheet bundle while restraining the double feeding is achieved, the control unit 100 sets a predetermined number of sheets to the number of feedable sheets. The predetermined number of sheets as the number of sheets to be set is set in the setting control of the predetermined number of sheets described below with reference to FIG. 9.

In addition, the number of feedable sheets corresponds to the number of sheets feedable without the manual sheet feeding unit 235 double-feeding the sheets until the air between the sheets flows out to return to the sheet bundle state before the floating, after the air blowing operation. The number of feedable sheets is cleared when the image forming apparatus 201 is turned from ON to OFF.

In step S307, the control unit 100 then starts a feeding operation of the sheet S. The start of the feeding operation indicates that the sheet S is fed by the pickup roller 501 rotating driven by the sheet feeding motor 520, in a state of contacting the uppermost sheet S in the sheet bundle. Thereafter, in a case where the sheets S are double-fed, the sheets S are separated by the separation unit configured of the feed roller 502 and the retard roller 503, and the passage of the separated sheet S is detected by the sheet feeding sensor 505.

In step S308, when one sheet S is fed, the control unit 100 decrements the number of feedable sheets (i.e., subtracts 1 from the number of feedable sheets). In step S309, the control unit 100 then determines whether the number of sheets S for printing have been fed. In a case where the number of sheets S for printing have been fed (YES in step S309), the control unit 100 advances the processing to step S310 to end the sheet feeding control by using the manual sheet feeding unit 235. The number of sheets may be, for example, the number of sheets designated in the print job.

In a case where the number of sheets S for printing have not been fed (NO in step S309), the processing returns to step S302. The control unit 100 then continues feeding the sheet S in steps S302 to S309 and also performs the air blowing operation for each of the sheet feeding operations of the predetermined number of sheets in steps S302 to S305. As described above, when the number of sheets S are fed, the control unit 100 performs the sheet S feeding operations and the air blowing operations as long as the sheet bundle stacked on the sheet stacking plate 514 of the manual sheet feeding tray 6 does not run out.

[Setting Control of Predetermined Number of Sheets]

Figure 9:
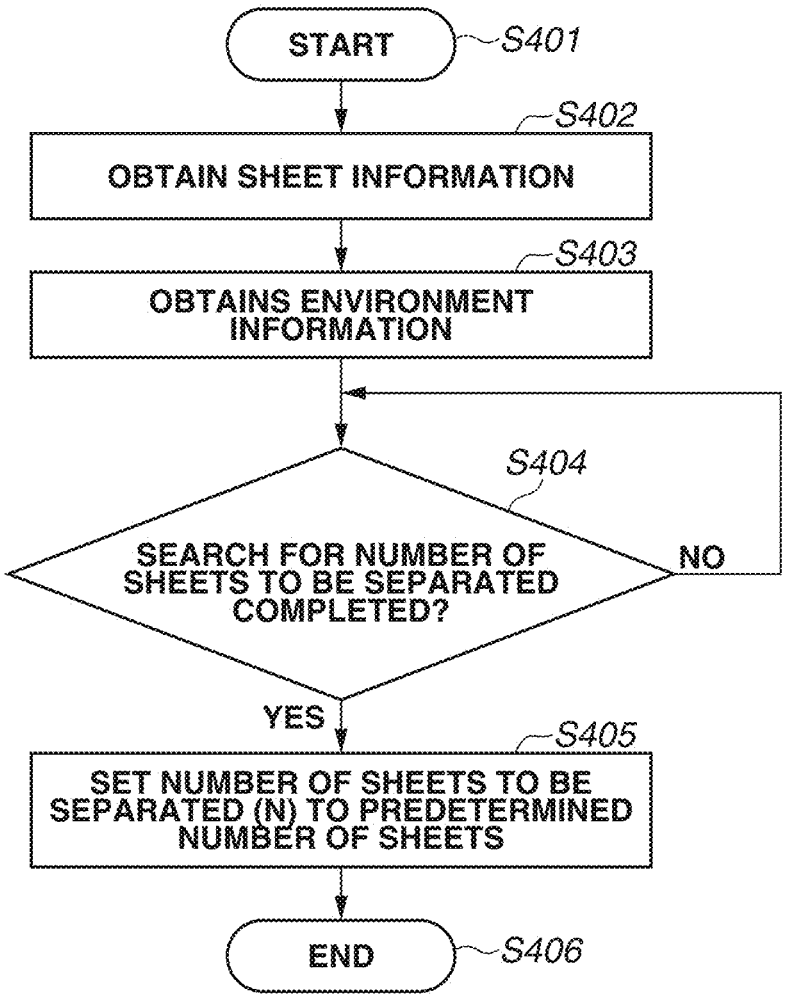
FIG. 9 is a flowchart illustrating a procedure of setting control of a predetermined number of sheets.

The setting control of the predetermined number of sheets will now be described with reference to FIGS. 8 and 9. FIG. 8 is a diagram illustrating a number of sheets to be separated correspondence table for obtaining the number of sheets to be separated based on the sheet information and the environment information. FIG. 9 is a flowchart illustrating a procedure of the setting control of the predetermined number of sheets.

As described above, if the air blowing operation is performed by the air blowing units 511A and 512A, the uppermost several to several tens of sheets are separated and floated as illustrated in FIG. 4, and the adhesive force between the floating sheets is reduced. However, the number of floating sheets is different depending on the attributes of the sheet such as a thickness and a weight of the sheet. Further, an amount of moisture included in the sheet changes depending on an environment such as a surrounding temperature and humidity, to cause the weight of the sheet to change. Thus, the predetermined number of sheets can be set based on the sheet attributes and the detection result of the environment sensor 800 by performing the setting control of the predetermined number of sheets described below.

Figure 7:
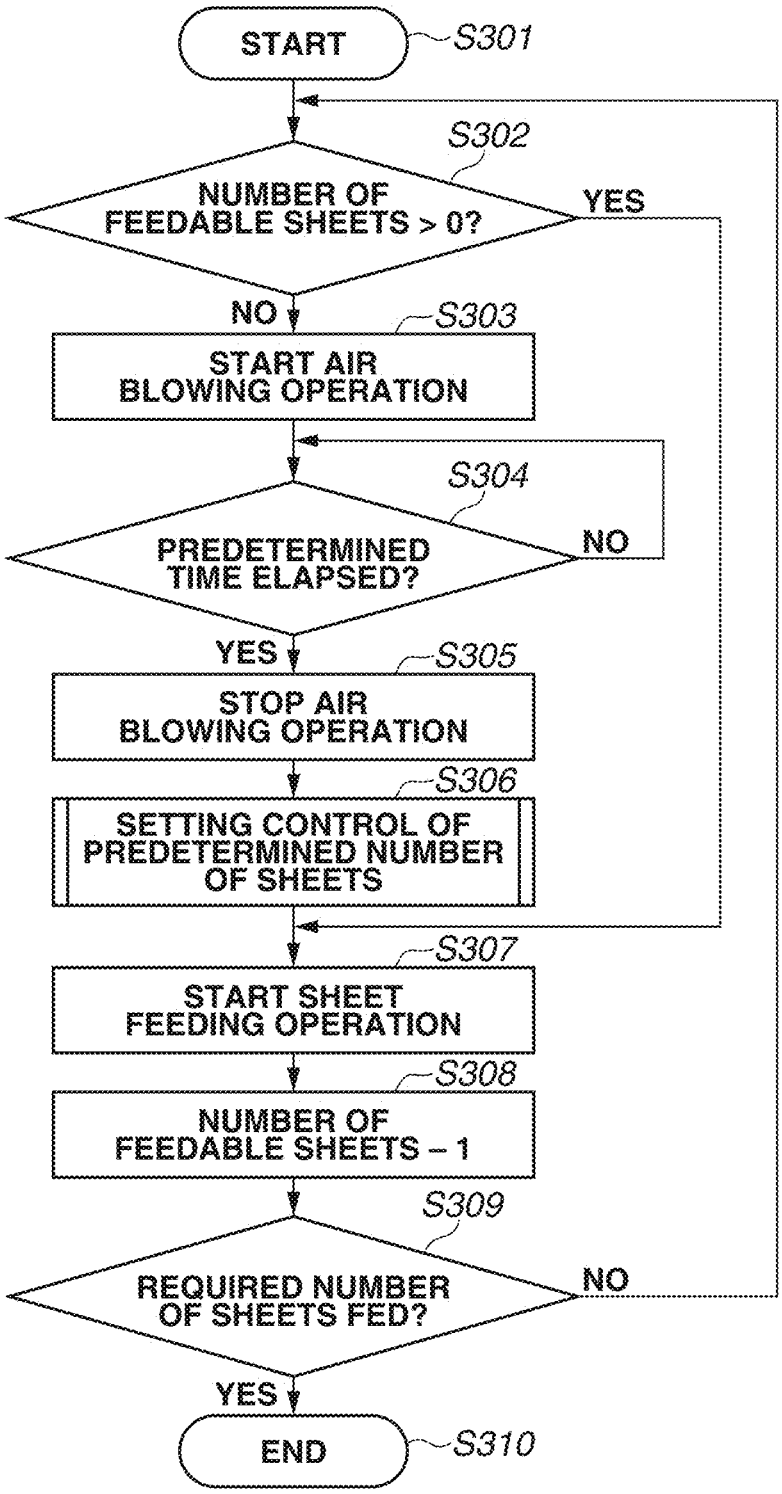
FIG. 7 is a flowchart illustrating a procedure of sheet feeding control.

In step S401, the control unit 100 starts the setting control of the predetermined number of sheets in response to the execution of the processing in step S306 in FIG. 7, as illustrated in FIG. 9. In step S402, the control unit 100 obtains the sheet information stored in the RAM 103 in the sheet attribute setting control (refer to FIG. 6). In step S403, the control unit 100 obtains the environment information regarding the temperature and humidity around the manual sheet feeding tray 6, based on the detection result of the environment sensor 800. The environment information may also be stored in the RAM 103.

In step S404, the control unit 100 then determines whether the search of the number of sheets to be separated that matches the sheet information and the environment information is completed, with reference to the number of sheets to be separated correspondence table illustrated in FIG. 8. The number of sheets to be separated correspondence table is stored in, for example, the ROM 102. In FIG. 8, "HH", "NN", and "NL" each indicate a range of the environment information. "HH" indicates a high-temperature and high-humidity environment. For example, the environment of the high-temperature is 30° C. or higher, and the environment of the high-humidity is 80% or higher. "NN" indicates a medium-temperature and medium-humidity environment. For example, the environment range of the medium-temperature is 23.5±5° C., and the environment of the medium-humidity is 50±10%. "NL" indicates a medium-temperature and low-humidity environment. For example, the environment range of the medium-temperature is 23.5±5° C., and the environment of the low-humidity 15±10%.

For example, in a case where "One-side coated 1" is designated in the sheet information and "HH" is designated in the environment information, the number of sheets to be separated is 10. In a case where the search for the number of sheets to be separated matching the sheet information and the environment information is completed (YES in step S404), the processing proceeds to step S405. In step S405, the control unit 100 sets the number of sheets to be separated (=N) found in step S404 as the predetermined number of sheets. In this way, in step S406, the setting control of the predetermined number of sheets ends.

In a case where "One-side coated 2" is designated in the sheet information, and "HH" is designated in the environment information, the predetermined number of sheets is 9. In other words, in a case of the same sheet type and if the sheets S having a first grammage (163 g/m$^2$ or less) are supported on the manual sheet feeding tray 6, the control unit 100 sets the predetermined number of sheets to 10 as a first number of sheets. In a case where the sheets having a second grammage (164 g/m$^2$ or more and 220 g/m$^2$ or less) larger than the first grammage are supported on the manual sheet feeding tray 6, the control unit 100 sets the predetermined number of sheets to 9 as a second number of sheets that is smaller than the first number of sheets by one. In this way, in the case of the same sheet type, as the grammage is larger, the sheet is heavier and the sheet is more difficult to float by the air blowing operation, and thus the predetermined number of sheets tends to decrease.

The values of the predetermined number of sheets and the number of sheets to be separated, however, are not limited to the values described in the present exemplary embodiment. Further, the setting control of the predetermined number of sheets does not need to be performed in step S306 and may be performed at any timing before the sheet conveyance in step S307 starts. For example, when the job is input and the sheet feeding control starts in step S301, the setting control of the predetermined number of sheets may be performed.

In the present exemplary embodiment, the control unit 100 performs the sheet feeding control illustrated in FIG. 7 on the coated paper or the water-resistant paper, i.e., the sheet feeding control including the air blowing operation to blow air to the side surfaces of the sheet bundle by using the air blowing units 511A and 512A, as illustrated in FIG. 8. In contrast, the control unit 100 performs another sheet feeding control on the thin paper, the plain paper, and the tick paper, to perform the sheet feeding operation by the sheet feeding unit 506 without performing the air blowing operation by using the air blowing units 511A and 512A. The thin paper, the plain paper, and the thick paper are non-coated sheets, and the thin paper is a sheet having a grammage of, for example, 52 to 63 g/m$^2$. The plain paper is a sheet having a grammage of, for example, 64 to 105 g/m$^2$. The thick paper is a sheet having a grammage of, for example, 106 to 163 g/m$^2$.

As described above, in the present exemplary embodiment, the air blowing operation is performed by the air blowing units 511A and 512A, and therefore it is possible to reduce the adhesive force between the sheets having a smooth surface property and a tendency of a high adhesive force. Whereby, it is possible to reduce a conveyance trouble, in which the pickup roller 501 slips and the sheet cannot be conveyed, for example.

Further, the sheet S is fed after the air blowing operation by the air blowing units 511A and 512A is stopped, and therefore the skew feeding of the sheet can be reduced. The skew correction amount becomes small when the registration roller pair 240 corrects the sheet skew feeding, and thereby it is possible to reduce the variation of the position of the sheet conveyed to the secondary transfer portion 201D. The print accuracy (quality) can be improved, accordingly.

In the present exemplary embodiment, the appropriate "predetermined number of sheets" can also be set based on the attributes of the sheets supported on the manual sheet feeding tray 6 or the detection result of the environment sensor 800. In the sheet feeding control, the control unit 100 then performs the air blowing operation again when the sheet feeding operation is performed by the sheet feeding unit 506 on the predetermined number of sheets after the air blowing operation is performed by the air blowing units 511A and 512A. In this way, it is possible to appropriately reduce the adhesive force between the sheets by performing the air blowing operation, to reduce the conveyance trouble of the sheet, such as double feeding.

In addition, in the exemplary embodiment described above, the sheet feeding control in the manual sheet feeding unit 235 provided with the air blowing units 511A and 512A is described. However, it is not limited thereto, and the sheet feeding control according to the present exemplary embodiment may be performed in the sheet feeding units 230 each including the feeding cassette 1, or the sheet feeding deck 500 provided with the air blowing units 511A and 512A. In a case where the sheet feeding control according to the present exemplary embodiment is performed in the sheet feeding units 230, the sheet feeding control may be performed in any stage of those in the vertical direction. In other words, the sheet support portion supporting the sheet bundle may have any configuration.

In the exemplary embodiment described above, the configuration is described including the pickup roller configured to feed the sheet, and the sheet feeding roller and the retard roller configured to separate the double-fed sheets and performing the sheet feeding operation and the separation operation. However, it is not limited thereto, and any configuration may be employed of the sheet feeding unit for feeding the sheet, such as a configuration of vacuum suctioning a sheet to a belt or the like to convey the sheet.

In the exemplary embodiment described above, the description is also given of the configuration in which the control unit 100 is provided in the image forming apparatus 201. However, it is not limited thereto. The control unit 100 may be provided in the sheet feeding deck 500, i.e., the control unit 100 may be provided in any apparatus as long as the control unit 100 that can control the sheet feeding unit and the air blowing unit is electrically connected thereto.

In the exemplary embodiment described above, the predetermined number of sheets is also set based on the sheet information and the environment information, but it is not limited thereto. For example, the predetermined number of sheets may be set only based on the sheet information without using the environment information. More specifically, in the sheet feeding control, the air blowing operation may be performed again when the sheet feeding operation is performed on the predetermined number of sheets based on at least the attributes of the sheet supported on the manual sheet feeding tray 6 after the air blowing operation is performed by the air blowing units 511A and 512A.

In the exemplary embodiment described above, the air blowing is performed on both side surfaces in the width direction of the sheet bundle stacked on the sheet stacking plate 514, but it is not limited thereto. For example, the air blowing may be performed only on one side surface in the width direction of the sheet bundle and may be performed on the front side surface or the back side surface of the sheet bundle.

In the exemplary embodiment described above, the image forming apparatus 201 including the manual sheet feeding unit 235 and the control unit 100 is described as the sheet feeding apparatus, but it is not limited thereto. For example, the image forming system 600 including the sheet feeding deck 500 and the image forming apparatus 201 may be regarded as the sheet feeding apparatus. The manual sheet feeding unit 235 and the control unit 100 may also be regarded as the sheet feeding apparatus.

In the exemplary embodiment described above, the description is given using the electrophotographic type image forming apparatus 201, but the present disclosure is not limited thereto. For example, the present disclosure can be applied to an inkjet type image forming apparatus that forms an image on a sheet by discharging ink from a nozzle.

The present disclosure can be realized by processing of supplying a program for implementing one or more functions of the above-described exemplary embodiments to a system or an apparatus via a network or a storage medium and one or more processors in the system or the apparatus reading and executing the program. Further, the present disclosure can also be realized by a circuit (e.g., application specific integrated circuits (ASIC) or other types of circuits or circuitry) that can implement one or more functions.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2023-115500, filed Jul. 13, 2023, which is hereby incorporated by reference herein in its entirety.

What is claimed is:

1. A sheet feeding apparatus comprising:

a sheet support portion configured to support a sheet;

a sheet feeding unit configured to perform a sheet feeding operation to feed the sheet supported on the sheet support portion;

an air blowing unit configured to perform an air blowing operation to blow air to a side end of the sheet supported on the sheet support portion; and a control unit configured to perform sheet feeding control to perform the sheet feeding operation of feeding a predetermined number of the sheets, in a state where the air blowing operation is stopped, after the air blowing operation is performed and then the air blowing operation is stopped, wherein, in the state where the air blowing operation is stopped in the sheet feeding control, the control unit performs the sheet feeding operation in which the predetermined number of sheets is determined based on an attribute of the sheet and then the predetermined number of sheets are fed.

2. The sheet feeding apparatus according to claim 1, further comprising a detection sensor configured to detect temperature and humidity around the sheet support portion, wherein, in the state where the air blowing operation is stopped in the sheet feeding control, the control unit performs the sheet feeding operation in which the predetermined number of sheets is based on the attribute of the sheet and a detection result of the detection sensor.

3. The sheet feeding apparatus according to claim 1, wherein the attribute of the sheet includes a sheet type and a sheet grammage.

4. The sheet feeding apparatus according to claim 3, wherein the control unit determines the predetermined number of sheets to a first number of sheets, in a case where a predetermined type of a sheet having a first grammage is supported on the sheet support portion, and wherein the control unit determines the predetermined number of sheets to a second number of sheets that is one sheet fewer than the first number of sheets, in a case where the predetermined type of the sheet having a second grammage larger than the first grammage is supported on the sheet support portion.

5. The sheet feeding apparatus according to claim 3, wherein the control unit performs the sheet feeding control, in a case where the control unit determines that the sheet supported on the sheet support portion is coated paper or water-resistant paper, and wherein the control unit performs other sheet feeding control to perform the sheet feeding operation without performing the air blowing operation, in a case where the control unit determines that the sheet supported on the sheet support portion is thin paper, plain paper, or thick paper.

6. The sheet feeding apparatus according to claim 1, further comprising an operation unit configured to be operable by a user to select an attribute of the sheet supported on the sheet support portion, wherein the control unit determines the predetermined number of sheets based on information regarding the attribute of the sheet selected via the operation unit.

7. The sheet feeding apparatus according to claim 1, further comprising a housing, wherein the sheet support portion is a tray that is provided on a side surface of the housing and rotatably supports the sheet with respect to the housing.

8. The sheet feeding apparatus according to claim 1, further comprising a side end regulation portion configured to regulate a position of the side end of the sheet supported on the sheet support portion, wherein the air blowing unit is provided to be movable together with the side end regulation portion.

9. The sheet feeding apparatus according to claim 8, wherein the air blowing unit includes a fan configured to blow air, and an air blowing port configured to blow the air blown from the fan to the end side of the sheets supported on the sheet support portion.

10. An image forming apparatus comprising:

the sheet feeding apparatus according to claim 1, and an image forming unit configured to form an image on the sheet fed by the sheet feeding apparatus.

11. The sheet feeding apparatus according to claim 1, wherein the control unit performs the sheet feeding control, after feeding the predetermined number of sheets, the sheet feeding operation is stopped, and then the air blowing operation is performed in the state where the sheet feeding operation is stopped, then, the sheet feeding operation of feeding the predetermined number of the sheets is resumed in the state where the air blowing operation is stopped.

12. A sheet feeding apparatus comprising:

a sheet support portion configured to support a sheet;

a sheet feeding unit configured to perform a sheet feeding operation to feed the sheet supported on the sheet support portion;

an air blowing unit configured to perform an air blowing operation to blow air to a side end of the sheet supported on the sheet support portion;

a detect sensor configured to detect temperature and humidity around the sheet support portion, and a control unit configured to perform sheet feeding control to perform the sheet feeding operation of feeding a predetermined number of the sheets, in a state where the air blowing operation is stopped, after the air blowing operation is performed and then the air blowing operation is stopped, wherein, in the state where the air blowing operation is stopped in the sheet feeding control, the control unit performs the sheet feeding operation in which the predetermined number of sheets is determined based on a detection result of the detection sensor and then the predetermined number of sheets are fed.

* * * * *